US009266630B2

(12) United States Patent
Peterson et al.

(10) Patent No.: US 9,266,630 B2
(45) Date of Patent: Feb. 23, 2016

(54) PROCESS FOR POUCH FORMING WITH OPTIMIZED FILL-ACCURACY AND HEADSPACE

(75) Inventors: Jason G. Peterson, Lewis Center, OH (US); Joshua Michael Schutte, Columbus, OH (US)

(73) Assignee: LIQUI-BOX CORPORATION, Worthington, OH (US)

( * ) Notice: Subject to any disclaimer, the term of this patent is extended or adjusted under 35 U.S.C. 154(b) by 751 days.

(21) Appl. No.: 12/707,344

(22) Filed: Feb. 17, 2010

(65) Prior Publication Data

US 2010/0215813 A1 Aug. 26, 2010

Related U.S. Application Data

(60) Provisional application No. 61/155,287, filed on Feb. 25, 2009.

(51) Int. Cl.
*B65B 1/24* (2006.01)
*B65B 9/20* (2012.01)
*B65B 9/213* (2012.01)

(52) U.S. Cl.
CPC ..... *B65B 9/2049* (2013.01); *B65B 9/213* (2013.01); *B65B 9/2007* (2013.01)

(58) Field of Classification Search
CPC ..... B65B 9/2049; B65B 9/213; B65B 9/2007
USPC ..... 53/436, 433, 451, 374.8, 552, 52
See application file for complete search history.

(56) References Cited

U.S. PATENT DOCUMENTS

| | | | | | |
|---|---|---|---|---|---|
| 3,545,983 | A * | 12/1970 | Woods | 426/395 |
| 3,849,965 | A * | 11/1974 | Dominici | 53/451 |
| 4,215,520 | A * | 8/1980 | Heinzer et al. | 53/173 |
| 4,457,122 | A * | 7/1984 | Atkins et al. | 53/434 |
| 4,769,974 | A * | 9/1988 | Davis | 53/433 |
| 4,964,259 | A * | 10/1990 | Ylvisaker et al. | 53/433 |
| 5,170,609 | A * | 12/1992 | Bullock et al. | 53/434 |
| 5,241,804 | A * | 9/1993 | Tsuruta et al. | 53/504 |
| 5,546,733 | A * | 8/1996 | Paltrinieri | 53/503 |
| 6,289,654 | B1 * | 9/2001 | Yamaguchi et al. | 53/434 |
| 6,735,928 | B2 * | 5/2004 | Kondo et al. | 53/508 |
| 7,779,612 | B2 * | 8/2010 | Fergusson et al. | 53/451 |
| 2008/0209864 | A1 | 9/2008 | Fergusson et al. | |
| 2010/0215813 | A1 | 8/2010 | Peterson et al. | |

FOREIGN PATENT DOCUMENTS

| | | | |
|---|---|---|---|
| EP | 0381400 | * | 11/1988 |
| WO | WO 2010/099023 A1 | | 9/2010 |

OTHER PUBLICATIONS

The International Search Report and Written Opinion of the International Searching Authority, Application No. PCT/US2010/024558, Mailed Jun. 7, 2010.
Copending U.S. Appl. No. 12/074,571, filed Mar. 5, 2008.

* cited by examiner

*Primary Examiner* — Sameh Tawfik
(74) *Attorney, Agent, or Firm* — Baker & Hostetler LLP

(57) ABSTRACT

This invention discloses a process for forming a pouch having an evacuated headspace containing a flowable material. The process relates to optimizing both, the evacuation of the headspace in the pouch and the accuracy of the flowable material filled in the pouch. Specifically, the present invention employs a process that includes a multiple-step or a continuous compression of the pouch headspace to accomplish the goals. Also disclosed is a vertical form-fill-seal apparatus for forming a pouch containing a flowable material and having an evacuated headspace.

12 Claims, 4 Drawing Sheets

PROCESS FOR POUCH FORMING WITH OPTIMIZED FILL-ACCURACY AND HEADSPACE

CROSS-REFERENCE TO RELATED APPLICATION

This application claims the benefit of U.S. Provisional Application No. 61/155,287 which was filed Feb. 25, 2009, of which is incorporated by reference herein in its entirety.

FIELD OF INVENTION

In one of its aspects, the present invention provides a process for forming a pouch with optimized headspace volume and optimized accuracy of the flowable material contained in the pouch. In another of its aspects, the present invention provides an apparatus for forming pouches with optimized headspace volume and optimized accuracy of the flowable material contained in the pouches. In yet another of its aspects, the present invention provides a pouch with optimized headspace volume and optimized accuracy of the flowable material contained in the pouch formed by the process of the present invention.

BACKGROUND

Flexible liquid-packaging is used to package many consumer goods, particularly food and beverages, which are often packaged in pouches made from flexible materials. The term "liquid-packaging" is understood by those of skill in the art to refer to both liquids and other flowable materials or product.

Two aspects are important in flexible liquid-packaging: (i) optimal headspace in the pouch; and (ii) optimal fill-accuracy of the flowable material contained in each pouch. By "optimal" or "optimized" is meant that the two important factors—headspace over the product in the pouch, and fill-accuracy of the product amount in the pouch—are minimized without sacrificing one over the other such that both factors remain acceptable for packaging use. It should be noted that minimizing one factor tends to adversely affect the other factor. Ideally the goal is fill-accuracy of 100% of target weight and a headspace of 0 $cm^3$. Practically, however, there is a trade off between good fill-accuracy and the amount of headspace in the pouch. Typically an improvement in fill-accuracy will result in a larger headspace volume. Similarly, lower headspace generally results in poor fill-accuracy. Therefore, optimizing and controlling these two parameters is the challenge for vertical form-fill-seal technology.

During pouch formation, oxygen is commonly trapped in the headspace above the product. However, many pouch products are particularly sensitive to oxygen degradation. Specifically in the food industry, many products require minimal oxygen exposure to protect their flavor, color, nutritive value, texture, and/or shelf-life. Oxygen reacts readily with some of these product components forming "off-flavors" and "off-colors". If oxygen is removed during the packaging process, then, for example, shelf-life of the food can be extended without loss of flavor. Thus, minimizing oxygen, and in turn, minimizing headspace in a pouch, is a desired objective in pouch formation.

Besides minimizing oxygen exposure, minimal headspace facilitates pouch insertion into a secondary container—a common packaging arrangement in which the flexible pouch is inserted in a cardboard box ("bag-in-box"). A slack pouch is easier to insert into a box and will better form to shape than an inflated pouch (that is, one with a large, air-filled headspace).

Fill-accuracy, that is reducing over-fill and under-fill of the pouch, is important because it can have economic or government regulatory implications. For example, many jurisdictions require that the advertised product quantity must be the minimum product quantity. Stated another way, the laws of the jurisdiction require that the amount of product in the pouch may be more than what is advertised, but not less. Thus, if the fill-accuracy is poor, a vendor, to comply with the law, must fill the pouch with product amount more than what is advertised. Therefore, poor fill-accuracy raises business cost for the vendor. Consequently, both limiting headspace and fill-accuracy should be adequately controlled. One known method for minimizing headspace involves filling the tube for making a pouch above the level of the pouch and sealing through the product. However, this method can suffer from poor fill-accuracy and product interfering with seal formation.

Thus, achieving good fill-accuracy and/or minimal headspace would help minimize product waste, minimize oxygen in the formed pouch, and allow for the final product to fit more easily into smaller packaging.

Several methods have been used to minimize fill-accuracy and headspace. The best fill-accuracy can be achieved by limiting interaction on the pouch in a way that relies only on the delivery system and non-critical pouch making devices. However, this results in unacceptably large headspace for production runs. On the other hand, minimal headspace can be achieved by having the product completely fill the current pouch and overfill into the next upstream pouch, so when the final seal is made, there is little or no air in the first pouch. Typical devices either press above or below the product zone after the pouch has indexed. Devices that press on the pouch above the product zone results in a minor reduction of headspace while maintaining good fill-accuracy. Devices that press on the pouch around the product zone can effectively raise the product above the sealing apparatus minimizing and/or eliminating headspace, but sacrificing fill-accuracy. It is important to note that cautious control of any device must be exercised while film is indexing to avoid film hang-up which would result in machine shutdown.

It is an object of the present invention to limit the above-mentioned disadvantages. Specifically, the present invention provides a process, apparatus, and a pouch in which the headspace has been minimized with a simultaneous increase in the accuracy of filling of the flowable material into the pouch. In addition, the present invention will also provide for higher pouch production rates. The asynchronous deflation process (one of the embodiments of the invention described infra) will allow the user to accommodate variations in film runnability, allowing for variety in film conditions without being limited by the speed of the machine.

SUMMARY OF INVENTION

This invention relates to a process for forming a pouch, said pouch having an evacuated headspace and containing a flowable material, said process comprising the steps of:

(A) providing a continuous tube of flexible and sealable film;

(B) supplying the continuous tube with a predetermined amount of flowable material;

(C) evacuating the headspace above said predetermined amount of flowable material; wherein said evacuation is performed continuously or in multiple steps, and wherein said continuous tube is transversely compressed at a point on said continuous tube where said continuous tube comprises the top portion of said predetermined amount of flowable material, wherein said transverse compressing is accomplished by deflating jaws while said pouch is indexing; and (D) pinching said continuous tube above a sealing region so as to form a pinched portion of said continuous tube;

(E) sealing said continuous tube at said sealing region to form a top seal of said pouch containing flowable material and a bottom seal of a next-to-be filled pouch.

This invention further relates to the above process, wherein said evacuation is performed in two steps:

(i) transversely compressing said continuous tube, at a point where said continuous tube comprises the top portion of said predetermined amount of flowable material, wherein said transverse compressing is accomplished by deflating jaws while said pouch is indexing; and (ii) further transversely compressing said continuous tube with deflating jaws near or at the end of said indexing of said pouch.

This invention further relates to a pouch formed according to a process comprising the steps of:

(A) providing a continuous tube of flexible and sealable film;

(B) supplying the continuous tube with a predetermined amount of flowable material;

(C) evacuating the headspace above said predetermined amount of flowable material; wherein said evacuation is performed continuously or in multiple steps, and wherein said continuous tube is transversely compressed at a point on said continuous tube where said continuous tube comprises the top portion of said predetermined amount of flowable material, wherein said transverse compressing is accomplished by deflating jaws while said pouch is indexing; and (D) pinching said continuous tube above a sealing region so as to form a pinched portion of said continuous tube;

(E) sealing said continuous tube at said sealing region to form a top seal of said pouch containing flowable material and a bottom seal of a next-to-be filled pouch.

This invention further relates to a pouch as described above, wherein said evacuation is performed in two steps:

(i) transversely compressing said continuous tube, at a point where said continuous tube comprises the top portion of said predetermined amount of flowable material, wherein said transverse compressing is accomplished by deflating jaws while said pouch is indexing; and (ii) further transversely compressing said continuous tube with deflating jaws near or at the end of said indexing of said pouch.

This invention also relates to a package comprising the pouch described above inside a secondary container such as a cardboard box.

This invention also relates to a vertical form-fill-seal apparatus for forming a pouch containing a flowable material and having an evacuated headspace, said apparatus comprising:

(A) a tube-forming section for forming a vertical continuous tube from a roll of film;

(B) a horizontal sealing section for forming a transverse seal across said vertical continuous tube;

(C) a filling station for supplying a predetermined amount of flowable material to said vertical continuous tube;

(D) pinchers for transversely pinching said vertical continuous tube to form a pinched portion of said continuous tube;

(E) an evacuating passage between said pinchers that opens onto said headspace between the predetermined amount of flowable material and the pinched portion; and (F) a deflating apparatus for evacuating said headspace via the evacuating passage, wherein said deflating apparatus is programmed to actuate in multiple steps or continuously while the continuous film is indexing.

BRIEF DESCRIPTION OF THE DRAWINGS

Embodiments of the present invention will be described with reference to the accompanying drawings, wherein like reference numerals denote like parts, and in which.

DETAILED DESCRIPTION OF THE INVENTION

Figure 1:
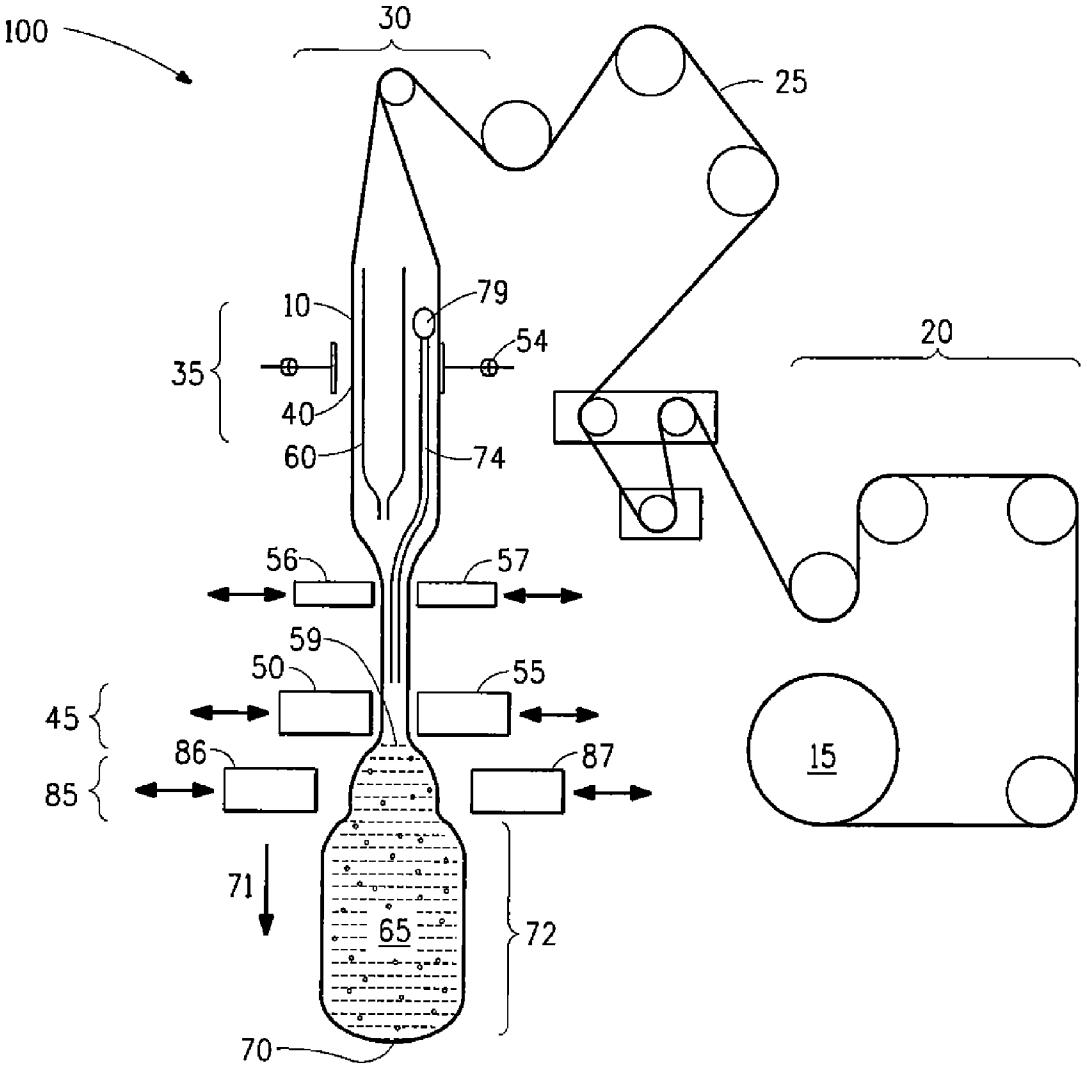
FIG. 1 illustrates a schematic view of an apparatus of the present invention.

The present invention relates to forming sealed pouches from a continuous film tube. Typically, the process steps for forming sealed pouches include: (i) forming the continuous film tube; (ii) forming a first seal in the continuous film tube; (iii) filling the continuous film tube with product; and (iv) forming a second seal above the product, thereby yielding a closed filled pouch. Typically, all process steps are performed on a vertical form-fill-seal ("VFFS") type machine. The continuous film tube is made from a flexible film. Flexible films are known to a person of ordinary skill in the art.

While pouch volume in the present invention is not particularly restricted, preferred pouch volume ranges from about 1 L to about 12 L, and more preferably, from about 3 L to about 5 L. The product volume in the pouch will depend on the pouch volume. In this application, the terms "minimal headspace" or "evacuated headspace" are used relative to standard pouches formed by the standard form-fill-seal process. The pouch headspace, resulting from the process of present invention, is less than about 2 percent of pouch volume. The fill-accuracy in the present invention is about 0.10%-0.67% of the total weight of the product.

Generally the pouch of the present invention should be sealable and have suitable properties (that is, strength, flexibility, etc.) for carrying the desired product. The pouch comprises any suitable plastic film material, such as linear low-density polyethylene. The pouch may comprise multiple plies. Each ply can have multiple layers. Each ply can also be a single layer. The film can have single or multiple plies. Thus, a film can also be simply one layer of the polymeric material.

An outer ply may be a barrier lamination ply including a layer made from a foil material or a suitable metallized substrate, or any other recognized flexible barrier or substrate material including non-metallized material. Alternatively, the barrier lamination could comprise an outer layer of polyethylene, an intermediate layer of metallized nylon, or metallized polyester, or metallized polyvinyl alcohol, and an inner layer of polyethylene.

In a preferred embodiment, the outer layer of the multilayer ply comprises polyethylene; the middle layer comprises metallized uniaxial or biaxial polyester; and the inner layer, that is the sealant layer comprises polyethylene.

In another preferred embodiment, the outer layer of the multi-layer ply comprises ethylene-vinyl alcohol coextrusion; the middle layer comprises biaxial nylon; and the inner layer, that is the sealant layer comprises polyethylene.

An example of EVOH coextrusion is a ply comprising polyethylene/tie layer/ethylene vinyl alcohol/tie layer/polyethylene.

In yet another preferred embodiment, the inner layer, that is, the sealant layer is polyethylene functionalized with vinyl acetate that helps in sealing and/or bonding the entire laminate. In another preferred embodiment, the outer layer of the multi-layer ply comprises polyethylene; the middle layer comprises uniaxial or biaxial nylon; and the inner layer, that is the sealant layer comprises polyethylene. Generally, clear barrier laminates are preferred.

In another preferred embodiment, the inner sealant layer can be modified in several ways. The modification is required to ensure good bonding between the inner sealant layer and the rest of the laminate, especially for the thermal lamination process. The outer polyethylene layer can also be modified in the same way. Modifications for inner or the outer layer include, but are not limited to, modification with vinyl acetate, blending with ethylene vinyl acetate, modification with methacrylic acid, methyl acrylate, acrylic acid, and other alkyl (alk) acrylates. The inner or the outer layer can also be the Nucrel® resin (obtained from E. I du Pont de Nemours & Co., Wilmington, Del.). The inner layer can also be a copolymer of ethylene and propylene. The inner layer can be an ionomer neutralized with zinc or sodium, e.g., the Surlyn® resin (obtained from E. I du Pont de Nemours & Co., Wilmington, Del.). Modification of polyethylene also includes reactive extrusion with maleic anhydride, e.g., Bynel® and Fusabond® resins (obtained from E. I du Pont de Nemours & Co., Wilmington, Del.).

In yet another embodiment, the outer polyethylene layer can be modified as described above; the middle layer is biaxial nylon, and the inner layer a polyethylene. A single-ply pouch containing a single layer can also be a polyethylene or modified polyethylene as described above. The plain polyethylene, can be a linear low-density polyethylene containing butene, hexene or octene copolymer.

In a preferred embodiment, one ply of a multi-ply laminate is plain polyethylene, and the multi-ply laminate optionally comprises a barrier ply.

Other alternate intermediate layers having suitable barrier characteristics include unmetallized polyvinyl alcohol, unmetallized ethyl vinyl alcohol, and metallized ethyl vinyl alcohol.

While the thickness of the films is not limitation to practicing the invention, an overall wall thickness of from about 50 μm to 175 μm is preferred. A wall thickness of from about 75 μm to about 150 μm is further preferred. A wall thickness of from about 100 μm to about 125 μm is even more preferred.

All materials are selected such that they can be sealed together, giving due consideration to the packaged product. Preferably, the package seal lines extend through the entire side wall—that includes all plies—to form a secure pouch seal.

FIG. 1 describes a generalized process of the present invention. A continuous film tube (10) is formed from a film roll (15) using the vertical form-fill-seal machine (100). The film roll (15) is unwound in the roll unwind (20) section. The unwound film (25) advances to the forming section (30). In the forming section (30), the film (25) folds itself vertically.

In the next step, that is, in the vertical sealing section (35), the longitudinal edges (40) of the film (10) are sealed together to form a vertical seal (35). Typical vertical seals include "lap seal" or a "fin seal." The present invention, however, does not restrict the vertical seal types. Other seal types are within the purview of a person of ordinary skill in the art. Suitable vertical sealing jaws include the thermic jaw, that is, a constantly heated jaw, or impulse jaw, that is, an intermittently powered jaw for each seal.

Also, as shown in FIG. 1, the form-fill-seal machine (100) further includes a horizontal sealing section (45). In the horizontal sealing section (45), the film tube (10) with its longitudinal edges already sealed, undergoes transverse heat-sealing. Typically, a pair of sealing jaws (50 & 55) helps form the transverse heat seal. A person of ordinary skill in the art understands that other sealing arrangements may be possible. For this description, however, horizontal sealing will be described in terms of sealing jaws (50 & 55). Typically, the sealing jaws (50 & 55) are also associated with a cutting apparatus (not shown). The cutting apparatus severs the pouch that has already been made and filled from the next-to-be filled pouch.

The machine (100) can also include spreader fingers (not shown) adapted to be inside the continuous film tube (10) that shape the tubular film towards a layflat configuration. The layflat configuration outwardly spreads the longitudinal edges of the continuous film tube (10).

The apparatus of the present invention further comprises a filling station, typically comprising a product balance tank (not shown) and a supply conduit (60) above horizontal sealing section (45).

After making the bottom horizontal seal (70), but before the sealing jaws (50 & 50) are closed, a quantity of product (65) is supplied to the continuous film tube (10) via the supply conduit (60), which fills the continuous film tube (10) upwardly from the transverse seal (70). The continuous film tube (10) is then caused to move downwardly a predetermined distance. This movement in called indexing (71) of the continuous film tube (10). This movement may be under the weight of the material (65) in the continuous film tube (10), or may be caused by pulling or mechanical driving of the continuous film tube (10). During indexing (71), the deflation apparatus (85) is activated and the pouch (72) is squeezed in a two-step deflation process (see infra), which helps minimize the headspace. After the deflation step, the pinchers (56 & 57) are activated, closed and sealed. In the next step, the sealing jaws (50 & 55) are closed, thus collapsing the continuous film tube (10) at a second position. The sealing jaws can be closed above the air/product interface (59). The sealing jaws (50 & 55), in an alternate embodiment, can also be closed below the air/product interface (59), and within the section wherein there is only product. The sealing jaws (50 & 55) typically seal and sever the continuous film tube (10), or the tube may be severed subsequently.

In the embodiment of FIG. 1, a pouch (72) is shown advancing in between the deflator apparatus (85), which includes two sets of deflators (86& 87; second set of deflators is not shown in FIG. 1). The first set of deflators (86 & 87) help squeeze the product (65) in the pouch, while the second set of deflators (88 & 89; see FIG. 2) are used as a control to help keep the product liquid level higher after the first set of deflators' squeegee effect has diminished. While this embodiment shows one or two set of deflators, multiple sets of deflators can also be present and should be construed within the scope of the present invention.

This advancing movement also known as indexing (71) occurs prior to a two-step deflation process. The deflator apparatus (85) is not yet actuated. Some amount of product (65) has already filled into the pouch (72).

Figure 2:
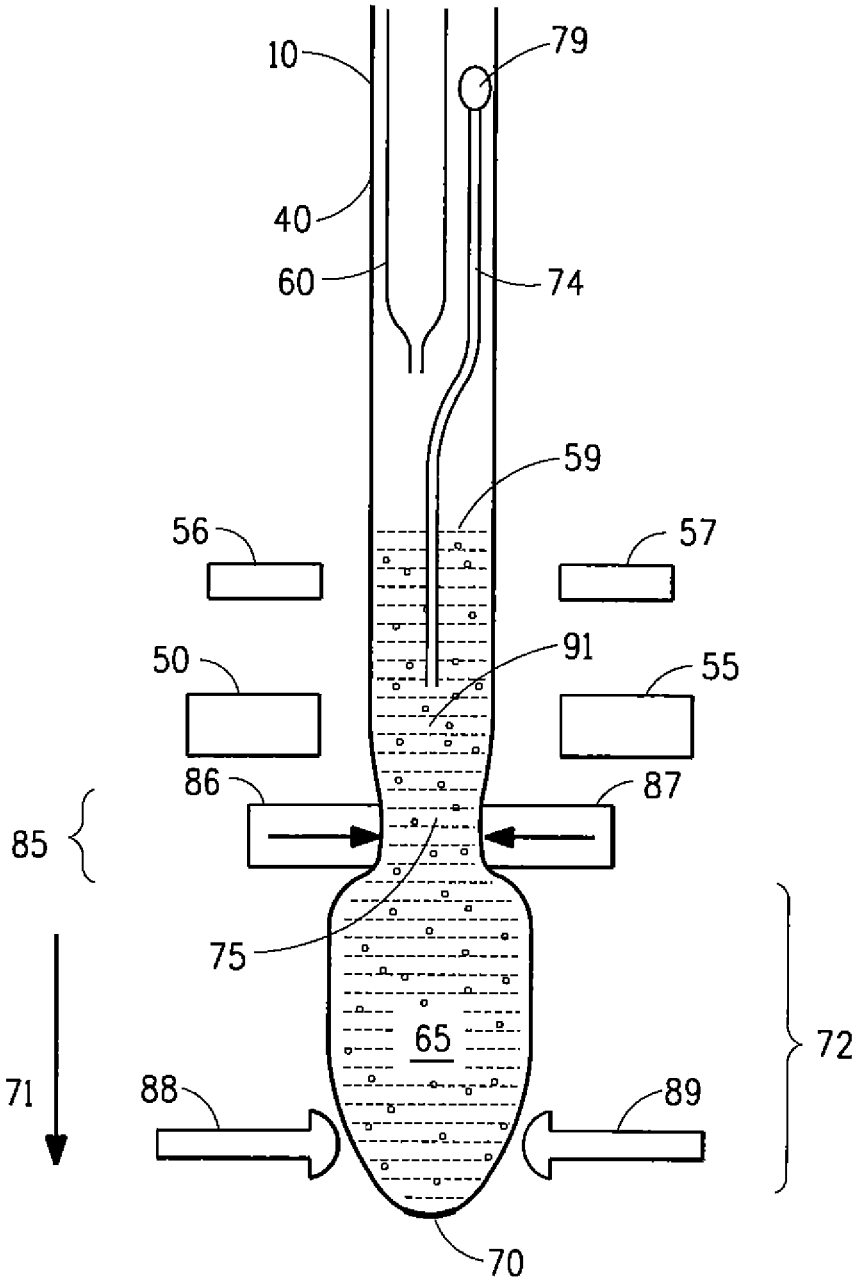
FIG. 2 illustrates a partial front schematic view of an embodiment of the apparatus with the first move of the activated deflators on the pouch as it is indexing.

In the embodiments of FIG. 1 and FIG. 2, and subsequent embodiments infra, we have described the present invention as a two-step deflator action process. However, the two-step deflator action is only for illustration purposes. This invention also includes those embodiments with multiple deflator actions, that is deflation carried out in multiple steps. This invention also includes the embodiment in which the deflator action is continuous, which would be equivalent to dividing the deflator action in infinitesimally small steps.

Products suitable for the pouch of the present invention are flowable materials. The term "flowable material" does not include gases, but includes materials which are flowable under gravity, may be pumped or otherwise transported through tubes. Such materials include emulsions, e.g. ice cream mix; soft margarine; food dressings; pastes, etc. meat pastes; peanut butter; preserves, e.g. jams, pie fillings, marmalade, jellies; dough; ground meat, e.g. sausage meat; powders, e.g. gelatin powders; detergents; liquids, e.g. milk, oils; granular solids, e.g. rice, sugar; and mixtures of liquids and solids, e.g. chunky soup, cole slaw, macaroni salad, fruit salad, sliced pickles, cherry pie filling. In one application, the flowable material is a liquid suitable for consumption, for example fruit juice, milk, and wine.

Each pouch formed contains a predetermined amount of product (65). Supplying each pouch with a predetermined amount of product (65) can be achieved by accurately metering-in product by methods known in the art for either continuous fill or intermittent fill operations. Suitable methods of metering-in, for example, may employ constant (continuous) flow of product and an accurate sealing sequencing timer or any known dosing method enabling intermittent filling of the product.

As shown in FIG. 2, while the continuous film tube (10) is indexing (71), a deflating apparatus (85) is employed to evacuate the headspace, for example, through an evacuating passage (74; see also FIG. 1; described infra) in case where the film tube (10) is already pinched-off. In one embodiment, the deflating apparatus (85), through its deflators (86-89), squeezes the portion (75) of the pouch that already contains the product and not simply that portion that corresponds to the headspace.

In a preferred embodiment, the deflation process is accomplished in two steps, or two squeezing actions ("moves") on the pouch (72). The first step (as shown in FIG. 2), occurs while the pouch (72) is indexing (71) through the VFFS device. This move is coordinated in such manner that the two sets of deflators (86-89) actuate and engage the pouch (72) only at a certain point (91) in time when the likelihood of pouch (72) hang-up has receded. A person skilled in the art can set-up an automated process that coordinates such actuation and engagement. If the timing of the deflation is inaccurate, the deflators (86-89) will interfere with the indexing process and the pouch (72) will hang up, with the product (65) now filling in the pouch (72) as it rests on the deflators (86 & 87). Stated another way, the weight of the pouch (containing some amount of product) that has already passed between the deflators is not sufficient that the pouch can move vertically downward, simply under gravity. The product filling into the pouch, which has hung-up, makes the indexing furthermore difficult.

Figure 3:
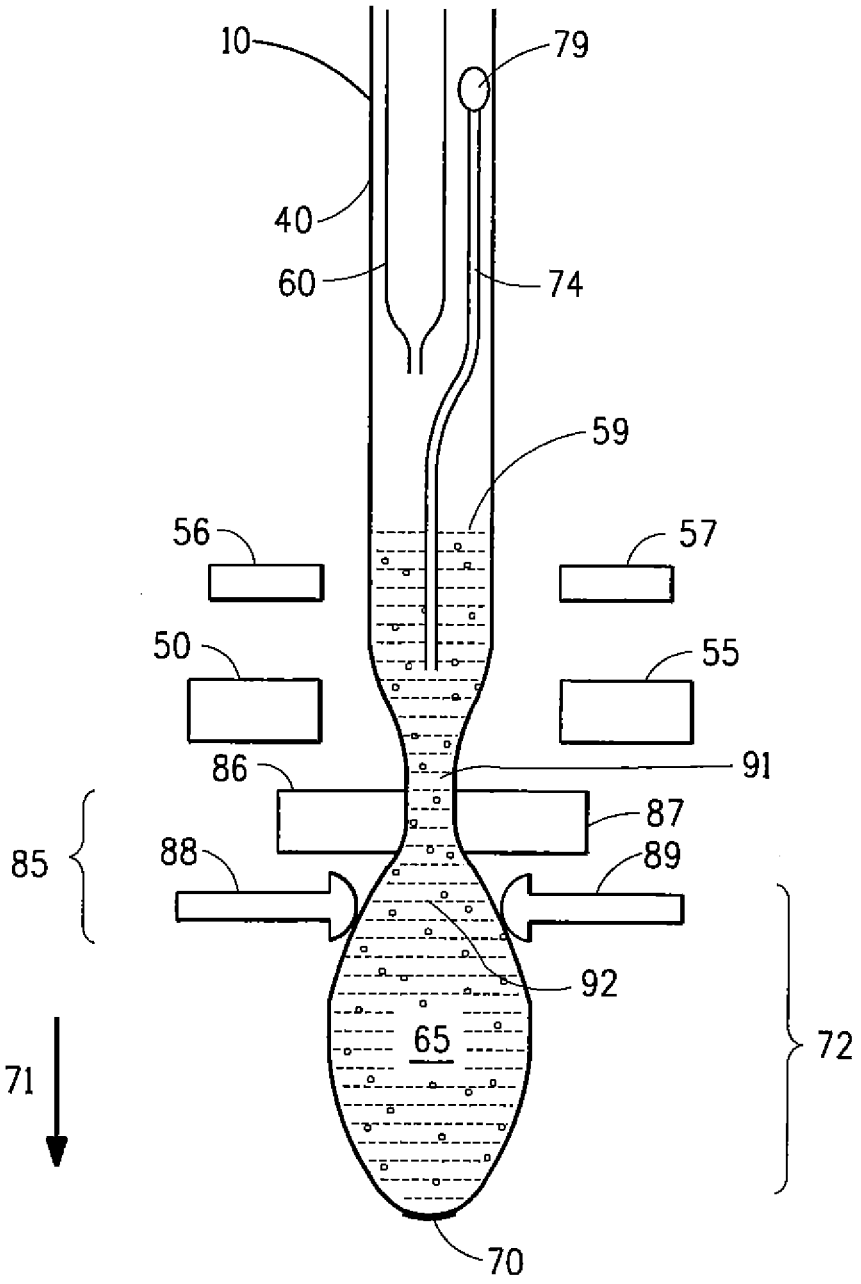
FIG. 3 illustrates a partial front schematic view of an embodiment of the apparatus with the second move of the activated deflators on the pouch at the completion of indexing.

The second step of the deflation process, as shown in FIG. 3, occurs to further squeeze the pouch (72) near the end of the indexing process (71). As shown in FIG. 2, the initial squeeze (91) dramatically decreases the headspace in the pouch (72) by a "squeegee" action, minimizes the amount of oxygen allowed to enter the pouch, and allows for the product to drain through the two sets of deflators (86-89). The draining action allows for improved fill-accuracy and also allows for the pouch (72) to index more easily. The second squeeze (92) of the deflators (86-89) further decreases the headspace in the pouch (72). The squeezing action can be accomplished with pneumatics, servos, or jets of air. Multiple surfaces can be used to construct the deflators, by those knowledgeable in the art, such as sheet metal or rollers. While this newly discovered process greatly reduces headspace and reduces the variability of the fill-accuracy, the settings (width and timing of the deflator's actuation) are dependent on how and when the device makes contact with the pouch while indexing.

Figure 4:
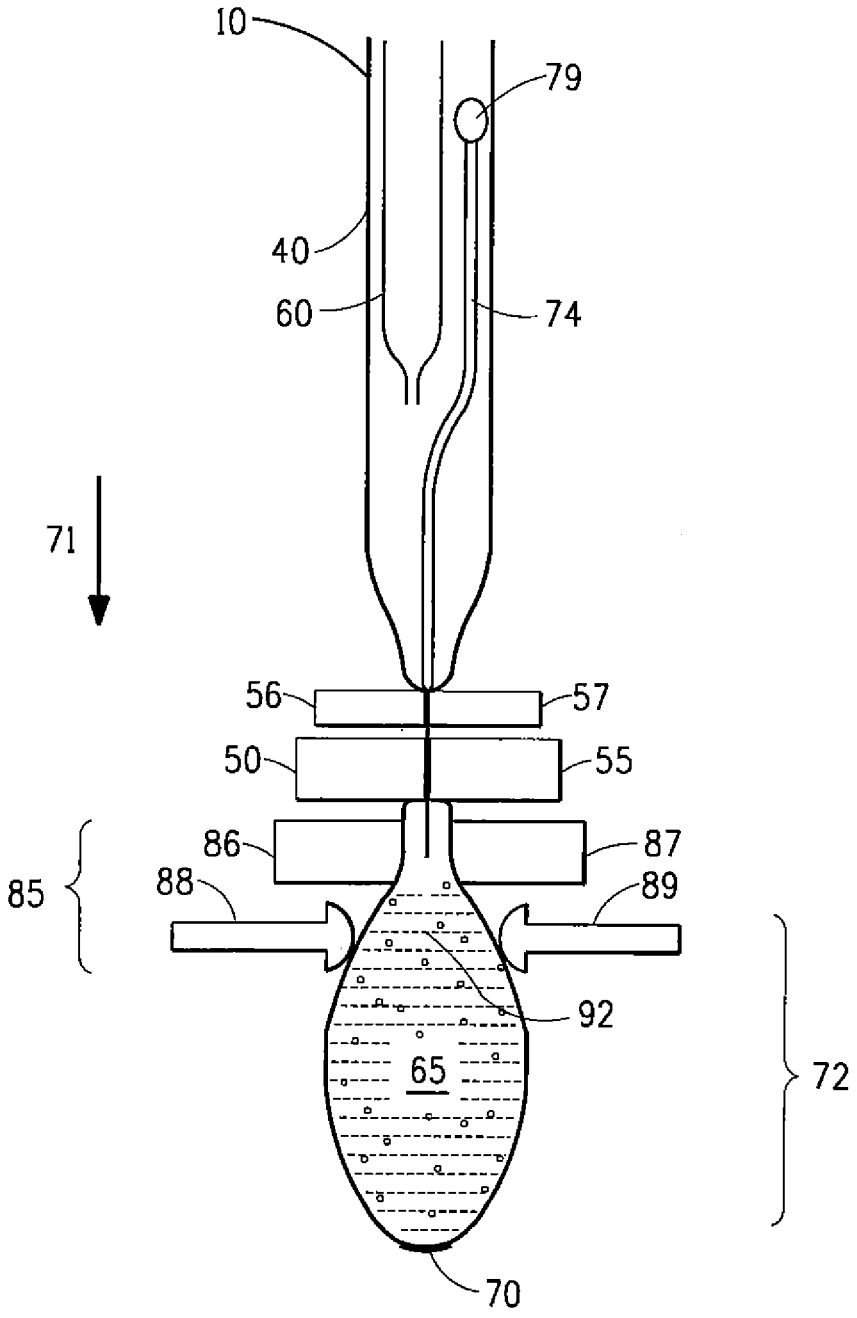
FIG. 4 illustrates a partial front schematic view of an embodiment of the apparatus with cutting and sealing jaws activated and the pinchers in a closed position.

FIG. 4 shows that while the pouch is undergoing the second step of deflation and is under a "squeeze" from the deflators (86-89), the pinching mechanism (56 & 57) is actuated and the sealing jaws (50 & 55) form the transverse seal. Suitably, the pouch (72) is simultaneously heat sealed and severed from a subsequent pouch (73). Alternatively, the pouch (72) may be sealed and subsequently cut from the subsequent pouch (73), such as by a knife. Another example for severing pouches formed in this manner could be through the use of a perforated or weakened tear line, which can be produced in any number of known ways. Suitable methods for separating pouches are known to those of skill in the art.

In this embodiment, after the two-step deflation process, and with the predetermined amount of product (65) metered-in to the continuous film tube (10), the set of pinchers (56 & 57) are closed to ensure product (65) stays inside the continuous film tube (10). In a continuous filling operation, the pinchers (56 & 57) also separate product (65) from the next pouch (73) being produced, as the product constantly pours in. The evacuating passage (74) permits evacuation of the headspace through the open or closed pinchers (56 & 57) while preventing flow of product from one pouch to the next. "Passage" refers to a path or route through which air can pass to evacuate the headspace between the pinchers.

In an alternative embodiment, the deflator width, that is, the distance between two deflators, is adjusted to control the fill-accuracy and the headspace volume. In an alternative embodiment, the deflator width is dynamically adjusted, that is, while the pouch is indexing and is being squeezed by the deflators, to control the fill-accuracy and the headspace volume.

In one embodiment, during the squeezing action, in both the first move and the second move, the pinchers (56 & 57) are generally open. However, in another embodiment, the pinchers can also be closed (FIG. 4). If the pinchers are closed, they are closed against the evacuating tube (74) (see FIGS. 1-4), which acts as the evacuating passage. The pinchers (56 & 57) can have a sealing material, such as a rubber ribbon for pinching about the evacuating tube (74). Securely pinching about the evacuating tube (74) so as to minimize product leaks promotes fill-accuracy.

The evacuating tube (74) passes between the pinchers (56 & 57) so that its head (79) opens on to the headspace between supplied predetermined amount of product (65) and the pinchers (56 & 57).

In another embodiment of the evacuating passage, the pinchers (56 & 57) extend across the width of the continuous film tube (10), but are closed with a force which allows evacuation through the closed faces of the pinchers (56 & 57), while limiting product flow. We incorporate in entirety the disclosure of U.S. patent application Ser. No. 12/074,571 by reference herein, which, inter alia, discusses different evacuation tubes for removing air from headspace of a pouch and different deflation apparatuses that can be used in the present invention.

Other deflating apparatuses are known to those of skill in the art; for example, blow-ers for impinging air blasts or aspiration can be used for deflating. The set of deflators is actuated to push air out to reduce or eliminate headspace. The deflators are suitably located below the sealing jaws and are designed to gently push air out through the evacuating passage until product is coming out and entering the evacuating passage. The particular pressure with which the deflators deflate the headspace will be readily ascertained by a person skilled in the art, and will depend on such variables as the size of the pouch, the machine speed, and the properties of the product being packaged. Preferably, the pressure applied is relatively gentle in order to limit build-up of pressure in the system, which may weaken seals. The low levels of applied pressure also facilitate headspace removal. As will be apparent to a person skilled in the art, the deflators could compress all or part of the headspace directly or could compress a portion of the pouch containing the predetermined amount of product. Where the evacuating passage is formed by closing of the pinchers with a reduced pressure, the air is pushed out between the pinchers, while product flow is prevented. Suitably, the distance of travel of the deflators can be controlled, which enables the production of a consistent volume in the pouch (or shape control). The distance traveled may be controlled by various apparatuses, including e.g. air or hydraulic cylinders or electric actuators.

One embodiment of the present invention includes a product sensor to monitor intake of product by evacuating tube and a control device for effecting this step. The deflators are controlled to optimally evacuate the headspace, while limiting evacuation of flowable product. Where an evacuating tube is employed, the deflators are controlled so as to cease evacuating air from the headspace into the evacuating tube once the product starts to flow into the evacuating tube. Settings are made to ensure that minimal flowable product enters the evacuating tube. Suitable sensors are known to persons skilled in the art and include, for example, a capacitance probe, an ultrasonic sensor and a light sensor. The product sensor may be mounted inside or outside the evacuating passage, and inside or outside the continuous film tube. The present invention provides an accurate method for determining when headspace has been minimized, because once product comes out, essentially all headspace has been eliminated. Further, this method is independent of fill control or reliability. This method is suitable for both continuous or intermittent filling operations.

In one embodiment of the invention, the squeezing times of the deflators are changed asynchronously or dynamically. By asynchronous or dynamic deflation is meant that while the two deflator widths are fixed, the point in time at which the squeezing is initiated, changes. This changing starting point is based on the position of a known location on the film during indexing, for each and every individual pouch. As a result, rather than the deflator mechanism getting actuated at specific periodicity, the deflators are actuated depending upon the advancement or indexing of the film/pouch. The asynchronous deflation is accomplished by adding a sensor to detect the film position as it passes through a known relative position on the machine. This asynchronous timing allows the filler to accommodate variations in film runnability, allowing the filler to change with different film conditions and is not limited by the speed of the machine.

In another embodiment, as described above, where the squeezing times of the deflators are changed asynchronously or dynamically, the gap between the deflators is changed based on when a known locus on the film passes a references point during indexing.

The critical process discovery is making contact with the pouch while indexing. Many possible combinations exist to yield similar effects like multiple squeezing actions or a computer-aided manufacturing profile that would provide continuous squeezing of the pouch while pouches are indexing.

As described previously, in all embodiments, in order to form the final pouch, the pouch is severed from the next adjacent pouch. As explained above, typically the sealing jaws are associated with a cutting apparatus for severing the pouch from the next adjacent pouch. These steps of sealing and cutting can be performed in a simultaneous operation, commonly called a "seal-and-cut operation."

The process of the present invention can further include additional steps for minimizing product oxidation, examples of which are known in the art. An example of such a technique for minimizing product oxidation is nitrogen displacement (inerting with gaseous nitrogen or liquid nitrogen dosing) to obtain desired headspace oxygen levels. Another technique would be to form the continuous film tube using a film structure with oxygen absorbers or oxygen scavengers incorporated into the structure.

As will be apparent to a person skilled in the art, the minimal headspace itself minimizes product oxidation. In some applications, this can actually enable packaging of an improved product. In the case of wine, for example, sulfites are added as a preservative. The acceptable level of sulfites in wine products is regulated to ensure acceptable levels for consumption. Limiting sulfite levels can improve taste and a low preservative product appeals to consumers. The minimal headspace pouch of the present invention is particularly suitable for packaging a reduced sulfite wine.

As will be apparent to a person skilled in the art, forming a pouch of the present invention may involve additional manufacturing steps (whether prior, during or after the process of the present invention); for example, the pouch may be fitted with a fitment prior to filling (i.e., by way of a fitment application press 54, such as is shown in FIG. 1.). The pouch may also form part of a larger package; for example, it may be inserted into a cardboard box (i.e., according to the "bag-in-box" principle).

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. For example, as will be apparent to persons skilled in the art, while a number of parts are described as being present in the singular or as a pair, there could be one, two or more of these components present in the apparatus of the present invention, for example, there could be multiple supply conduits, evacuating tubes, deflators, spreader fingers, pinchers, etc. Further, the present invention also encompasses a system for performing the process of the present invention. As will be apparent to a person skilled in the art, while the invention has been described in terms of a single apparatus, the various steps of the process could be performed by different apparatuses that form part of a larger system.

EXPERIMENTAL

Comparative Example 1

A prototype filler Crystalon™ Vertical Form Fill Seal (VFFS) machine was set up to run 3000 g-pouches at the rate of 25 pouches per minute. The filler used a gravity-fed balance tank with a constant-flow delivery system and sequenced, timed sealing system. Deflators were set to a wide position to allow pouches to be sealed. The deflators made contact with the pouch only after indexing and before the seal operation. Deflator move-1 and move-2 widths were set to 5 mm. Widths denote the gap between the deflator jaws. The system also had an aspirated valve-controlled evacuation head extended through a set of pouch pinchers. Under steady state operation, pouches were collected, and weighed. The purpose of this example was to show the best fill-accuracy that this system can achieve. Fifty pouches were collected in a single run after the filler has stabilized. The pouches were then weighed and a standard deviation was calculated. While the reported fill-accuracy (pouch weight standard deviation) was 2 g, the head space was unacceptably greater than 150 $cm^3$, or 5% of the product volume. Results are summarized in Table 1.

Comparative Example 2

The prototype filler Crystalon™ Vertical Form Fill Seal (VFFS) machine used in Comparative Example 1 and set to run 3000 g-pouches was modified with a set of sequenced, two-move deflators. The first move was a preparatory step to get it proximate to the pouch. The second move made contact with the pouch after the index. There was no contact of the deflators with the pouch during indexing. Deflator move 1 width was held at 20 mm and move 2 width was held at 1 mm. Under steady state operation, twenty-five pouches were collected in a single run, weighed, and headspace was estimated from every fifth collected pouch. The reported fill-accuracy was 5.59 g and the average headspace was estimated at 78.4 $cm^3$. The purpose of this experiment was to show the typical operation of deflators without the new process improvement. Results are summarized in Table 1.

Example 1

Synchronous Deflator Timing

The prototype filler Crystalon™ Vertical Form Fill Seal (VFFS) machine used in Comparative Example 2 and set to run 3000 g-pouches was modified with a set of sequenced, two-move deflators. Timing of deflators was adjusted to make contact with the pouches as the pouches were indexing. In both moves, the deflators contacted the pouch while it indexed. Deflator move 1 width was maintained at 40 mm while move 2 width was maintained at 3 mm. Two different film rolls were tested. Under steady state operation, fifty pouches were collected in nine runs, weighed, and headspace was estimated from every other pouch for seven of the nine runs, and from every fifth pouch for two of the nine runs. The reported fill-accuracy ranged from 5.19 g to 15.49 g and the average headspace range was estimated at 28.5 $cm^3$ to 50.0 $cm^3$. Results are summarized in Table 1.

Example 2

Asynchronous Deflator Timing

The machine used in Example 1 and set to run 3000 g-pouches was modified to allow the deflators moves to be asynchronously-triggered by a predetermined index position on the pouch. Sequenced timers were updated by offsets when the predetermined index position reached the sensor. Again, the deflators in both moves contacted the pouch only during indexing. Deflator move 1 width was held at 5 mm and move 2 width was held at 1 mm. Two different film rolls were tested. Under steady state operation, fifty pouches were collected in three runs, weighed and headspace was estimated from every other collected pouch. The reported fill-accuracy ranged from 8.29 g to 11.59 g and the average headspace range was estimated at 27.3 $cm^3$ to 31.7 $cm^3$.

Results are summarized in Table 1, which shows the results for a 3-liter pouch filled with water on the Crystalon™ Vertical Form Fill Seal (VFFS) machine utilizing asynchronous deflator timing. The deflator moves were setup widths that are adjustable via a Human Machine Interface (HMI) screen. The width of the deflators move 1 and move 2 was in reference to the gap between the deflators at the end of the motion. The fill-accuracy was determined by weighing fifty consecutive pouches. Headspace was estimated by an inverted cone measurement and calculation.

Example 3

Asynchronous Deflator Timing

The machine used in Example 2 and set to run 3000 g-pouches was modified with different setup widths for the two deflator moves. Again, the deflators in both moves contacted the pouch while it was being indexed. Deflator move 1 width was maintained at 6 mm and move 2 width was held at 0 mm. Two different film rolls were tested. Under steady state operation, fifty pouches were collected in four runs, weighed and headspace was estimated from every other pouch. The reported fill-accuracy (pouch weight standard deviation) ranged 7.80 g to 10.56 g and the average headspace range was estimated at 30.5 $cm^3$ to 35.0 $cm^3$. Results are summarized in Table 1.

Example 4

Asynchronous Deflator Timing

The machine used in Example 3 and set to run 3000 g-pouches was modified with different widths for the two deflator moves. Two different film rolls were tested. Again, the deflators in both moves contacted the pouch while it was being indexed. Deflator move 1 width was 5 mm and move 2 width was 0 mm. Under steady state operation, fifty pouches were collected from two runs, weighed and headspace was estimated from every other pouch. The reported fill-accuracy ranged 13.37 g to 13.75 g and the average headspace range was estimated at 22.4 $cm^3$ to 25.3 $cm^3$.

All results are summarized in Table 1 on the next page. Also in Table 1, the headspace was calculated as percentage of the target volume of the product, which is 3 L. We note that the product for all the above Examples was water.

TABLE 1

Crystalon ™ Fill-Accuracy and Headspace Results

| Examples | Deflator Timing | Deflators Move 1 Width Gap | Deflators Move 2 Width Gap | Fill-Accuracy Range (g) Standard Deviation 1 σ | Headspace Range ($cm^3$) | Headspace Range % Product Volume (3 L)** |
|---|---|---|---|---|---|---|
| Comp. Ex. 1 | Synchronous, after film index | 5 mm | 5 mm | 2 | 150 | 5.0 |
| Comp. Ex. 2 | Synchronous, after film index | 20 mm | 1 mm | 5.59 | 78.4 | 2.613 |
| Ex. 1 | Synchronous, while film is indexing | 40 mm | 3 mm | 28.5 | 28.5-50.0 | 0.950-1.667 |
| Ex. 2. | Asynchronous/ Dynamic, while film is indexing | 5 mm | 1 mm | 8.29-11.59 | 27.3-31.7 | 0.910-1.057 |
| Ex. 3. | Asynchronous/ Dynamic, while film is indexing | 6 mm | 0 mm | 7.80-10.56 | 30.5-35.0 | 1.017-1.167 |
| Ex. 4. | Asynchronous/ Dynamic, while film is indexing | 5 mm | 0 mm | 13.37-13.75 | 22.4-25.3 | 0.747-0.843 |

**[(Headspace Range * 100)/3000] %

LISTING OF PARTS

FIG. 1
100 Vertical form-fill seal machine
10 continuous film tube
15 roll of film
20 roll unwind section
25 unwound film
30 forming section
35 vertical sealing section
40 longitudinal edges of the film
45 horizontal sealing section
50 & 55 horizontal sealing jaws
54 fitment application press
56 & 57 pinchers
59 air/product interface
60 supply conduit
65 predetermined amount of product
70 bottom horizontal seal
71 indexing process
72 pouch
74 evacuating tube
79 evacuation tube head at pincher interface
85 deflator apparatus
86-87 first set of deflators FIG. 2
10 continuous film tube
40 longitudinal edges of the film
50 & 55 horizontal sealing jaws
56 & 57 pinchers
59 air/product interface
60 supply conduit
65 predetermined amount of product
70 bottom horizontal seal
71 indexing process
72 pouch
74 evacuating tube
79 evacuation tube head at pincher interface
85 deflator apparatus
86-87 first set of deflators
88-89 second set of deflators
91 squeeze from first move of deflators FIG. 3
10 continuous film tube
40 longitudinal edges of the film
50 & 55 horizontal sealing jaws
56 & 57 pinchers
59 air/product interface
60 supply conduit
65 predetermined amount of product
70 bottom horizontal seal
71 indexing process
72 pouch
74 evacuating tube
79 evacuation tube head at pincher interface
85 deflator apparatus
86-87 first set of deflators
88-89 second set of deflators
92 squeeze from the second move of the deflators FIG. 4
10 continuous film tube
40 longitudinal edges of the film
50 & 55 horizontal sealing jaws
56 & 57 pinchers
60 supply conduit
65 predetermined amount of product
70 bottom horizontal seal
71 indexing process
72 pouch
74 evacuating tube
79 evacuation tube head at pincher interface
85 deflator apparatus
86-87 first set of deflators
88-89 second set of deflators
92 squeeze from the second move of the deflators

The invention claimed is:

1. A process comprising forming a pouch, said pouch having an evacuated headspace and containing a flowable material, said process comprising the steps of:

(A) providing a continuous tube of flexible and sealable film;

(B) supplying the continuous tube with a predetermined amount of flowable material;

(C) evacuating the headspace above said predetermined amount of flowable material;

wherein said evacuation is performed in two steps:

(i) transversely compressing said continuous tube, at a point where said continuous tube comprises the top portion of said predetermined amount of flowable material, wherein said transverse compressing is accomplished by deflating jaws while said pouch is indexing; and (ii) further transversely compressing said continuous tube with deflating jaws near or at the end of said indexing of said pouch; and wherein said transvers compressing is accomplished without stopping said pouch for such transverse compressions and wherein an evacuating passage is provided for removing air from said headspace;

(D) reducing headspace in the pouch by evacuation and allowing flowable material to remain in the pouch;

(E) forming an optimized head space and a pouch having the predetermined amount of flowable material;

(F) pinching said continuous tube above a sealing region so as to form a pinched portion of said continuous tube; and (G) sealing said continuous tube at said sealing region to form a top seal of said pouch containing flowable material and a bottom seal of a next-to-be filled pouch.

2. The process as recited in claim 1, wherein vacuum is applied to said evacuating passage.

3. The process as recited in claim 1, further comprising the step of separating said pouch from said next-to-be-filled pouch.

4. The process as recite in claim 1, wherein said deflating jaws are actuated at a specific time in the continuous process of pouch-making.

5. The process as recited in claim 1, wherein said deflating jaws are actuated for each pouch only when a certain point on said each pouch has indexed beyond a certain point of the pouch-making apparatus.

6. The process as recited in claim 5, wherein said deflating jaws apply varying pressure on said pouch.

7. The process as recited in claim 1, wherein the distance between said deflating jaws in the first step is fixed and/or the distance between the deflating jaws in the second step is fixed.

8. The process as recited in claim 1, wherein said deflating jaws apply varying pressure on said pouch, and wherein the distance between said deflating jaws in the first step and/ or the distance between the deflating jaws in the second step varies with time of indexing of said pouch.

9. The process as recited in claim 1, wherein said deflating jaws are present in more than one set of deflating jaws.

10. The process as recited in claim 1, wherein the step of pinching of said continuous tube occurs before the deflation process.

11. The process as recited in claim 1, wherein said deflating jaws are released after evacuating said headspace and before sealing the continuous tube.

12. The process as recited in claim 1, further comprising the step of sensing when flowable material is being evacuated from the continuous tube and ceasing evacuation upon sensing that flowable material is being evacuated.

* * * * *